United States Patent [19]

Pratt et al.

[11] 4,388,176

[45] Jun. 14, 1983

[54] HYDROCARBON CONVERSION PROCESS

[75] Inventors: Roy E. Pratt, Port Neches; Scott M. Sayles, Nederland, both of Tex.; Kerry W. Bowers, Birmingham, Ala.; Richard P. Scott, deceased, late of Groves, Tex., by Candice C. Scott, executrix

[73] Assignee: Texaco Inc., White Plains, N.Y.

[21] Appl. No.: 323,097

[22] Filed: Nov. 19, 1981

[51] Int. Cl.³ ..... C10G 11/05; C10G 25/03; C10G 51/06; C10G 55/08

[52] U.S. Cl. ..... 208/80; 208/85; 208/87

[58] Field of Search ..... 208/80, 85, 87

[56] References Cited

U.S. PATENT DOCUMENTS

| | | | |
|---|---|---|---|
| 3,770,614 | 11/1973 | Graven | 208/62 |
| 3,801,493 | 4/1974 | Youngblood et al. | 208/78 |
| 3,843,508 | 10/1974 | Wilson et al. | 208/89 |
| 3,869,378 | 3/1975 | Pollock et al. | 208/78 |
| 3,993,556 | 11/1976 | Reynolds et al. | 208/75 |
| 4,304,659 | 12/1981 | Pratt et al. | 208/164 |
| 4,354,922 | 10/1982 | Derbyshire et al. | 208/68 |

*Primary Examiner*—Delbert E. Gantz
*Assistant Examiner*—G. E. Schmitkons
*Attorney, Agent, or Firm*—Carl G. Ries; Robert A. Kulason; Robert Knox

[57] ABSTRACT

A process for conversion of paraffinic base petroleum cracking stocks to high octane motor fuels and petrochemical feedstocks in which paraffinic components are separated from the cracking stock to yield a deparaffined fraction which is hydrotreated and catalytically cracked and a paraffin fraction which is separately catalytically cracked whereby improved yields of normally gaseous olefins and normally liquid products including high octane motor fuel components are obtained.

14 Claims, 1 Drawing Figure

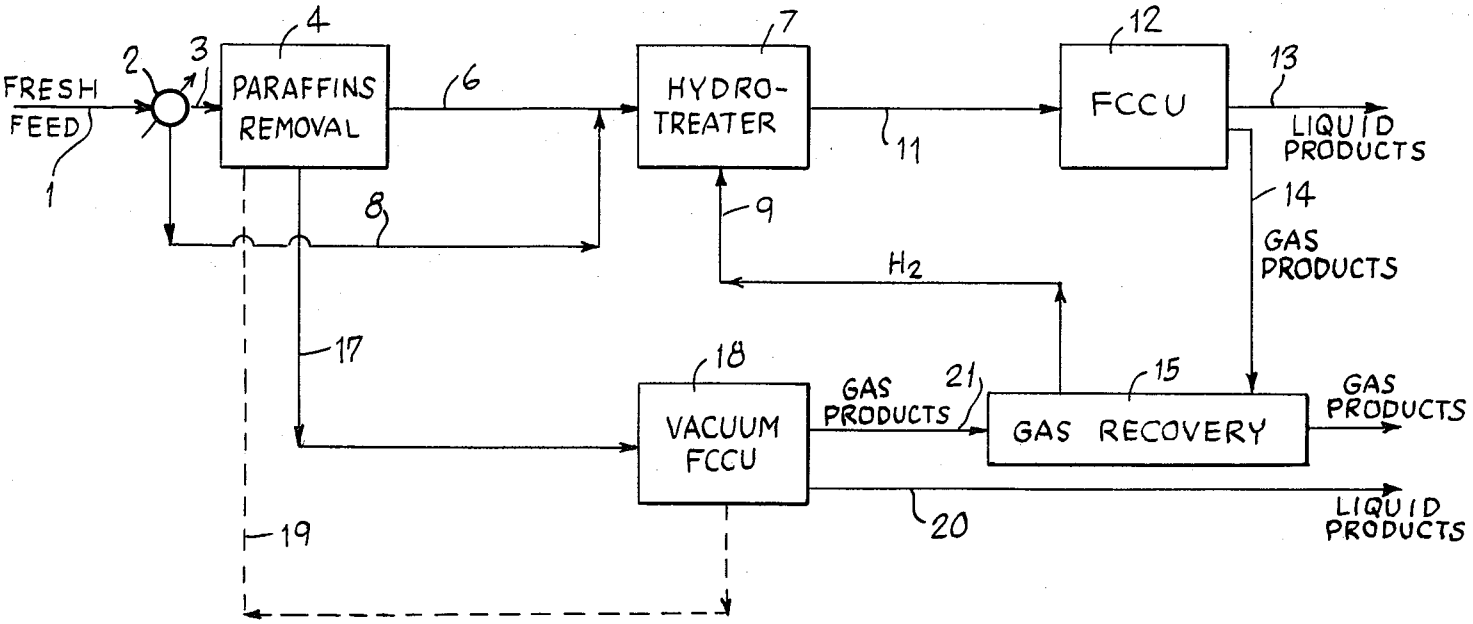
FRESH FEED
1
2
3
PARAFFINS REMOVAL
4
6
HYDRO-TREATER
7
8
9
11
FCCU
12
13
LIQUID PRODUCTS
14
GAS PRODUCTS
$H_2$
GAS RECOVERY
15
GAS PRODUCTS
LIQUID PRODUCTS
17
VACUUM FCCU
18
19
20
21
GAS PRODUCTS

HYDROCARBON CONVERSION PROCESS

This invention relates to a process for the conversion of a paraffin base petroleum hydrocarbon catalytic cracking feedstock to economically desirable products comprising high octane motor fuel components and petrochemical feedstocks. In one of its more specific aspects, the present invention relates to a process for the conversion of vacuum gas oils from paraffinic crude oils to improved yields of olefins and high octane gasoline blending components.

In a preferred specific embodiment, this invention relates to a process in which a paraffinic vacuum gas oil fraction suitable as chargestock for a fluid catalytic cracking unit is processed for the removal of at least a part of its paraffinic components thereby separating the gas oil into a deparaffined fraction and a paraffins-containing fraction. The deparaffined fraction is subjected to mild hydrogenation effecting saturation of its more readily hydrogenatable components and the resulting hydrotreated deparaffined fraction is subjected to catalytic cracking in a riser-type fluidized catalytic cracking reaction zone at a temperature in the range of 520° to 540° C. The paraffins-containing fraction is subjected to catalytic cracking in a second riser-type reaction zone at a temperature in the range of 650° to 700° C. The products of the two reaction zones are processed for the recovery of light olefins and motor fuel fractions including high octane motor fuel components.

Fluidized catalytic conversion processes, such as fluidized catalytic cracking for the processing of petroleum fractions are well known. In a fluidized catalytic cracking process, a hydrocarbon oil feedstock is contacted with a catalyst in a reaction zone under conditions such that the hydrocarbon feedstock is converted into desired products accompanied by the deposition of coke on the surface of the catalyst particles. Such systems may comprise a transport or riser type reaction zone through which the feed hydrocarbon and a solid particulate catalyst suspended in feed hydrocarbon vapors are passed concurrently. The reaction products and catalyst are discharged from the riser reaction zone into a separation zone in which hydrocarbons and normally gaseous by products of the cracking reaction are separated from the catalyst.

Gases and hydrocarbon vapors from the separation zone may be passed to a fractionation system, for the recovery of hydrocarbon liquid fractions and separation into desired product fractions according to their boiling ranges. For example, liquid hydrocarbons recovered from the product effluent from a fluidized catalytic cracking unit may be separated into a gasoline and lighter components fraction, a light cycle gas oil fraction, an intermediate cycle gas oil fraction, and a heavy cycle gas oil bottoms, or residual, fraction. Gases produced in the cracking reactions comprise hydrogen which may be recovered and utilized in the hydrogenation step in the process of this invention.

The yield of desirable products from a fluidized catalytic cracking process may be controlled within certain limits by selecting the charge stock, the catalyst, hydrocarbon conversion conditions within the reaction zone, i.e., the temperature, pressure and catalyst-oil contact time, the catalyst-to-oil ratio, etc.

In a riser reactor, as the mixture of catalyst and hydrocarbon vapors passes upwardly through the riser reaction zone, the catalyst is cooled by the endothermic cracking reactions. In such systems, the reaction temperature may be expressed in terms of an average temperature; preferably it is expressed as the temperature at the outlet of the riser reactor. During its passage through the reaction zone the catalyst becomes partially deactivated due to the deposition of coke thereon and is referred to as "spent" catalyst as contrasted with regenerated or "fresh" catalyst. The spent catalyst from the reaction zone may be regenerated by reaction with oxygen or air.

In the usual procedure, spent catalyst from the reaction zone is contacted in a stripping zone with a gaseous stripping medium, usually steam, to remove vaporizable entrained and occluded hydrocarbons from the catalyst. From the stripping zone, stripped catalyst may be passed into a regeneration zone where it is regenerated by burning coke deposits therefrom with an oxygen-containing gas, usually air. Regeneration of cracking catalysts takes place at elevated temperatures in the range of 600° to 750° C.; with the newer zeolite catalysts, regeneration temperatures are preferably in the range of 695° to 730° C. The resulting hot regenerated catalyst from the regeneration zone is supplied to the lower end of the riser reaction zone into contact with the hydrocarbon feedstock as catalyst for the desired cracking reactions and as a source of heat to vaporize and crack the hydrocarbon chargestock.

In a preferred form of this invention, there is provided an improved process for catalytically cracking a paraffinic hydrocarbon feed in which the feedstock is separated into two fractions, one highly paraffinic and the other more naphthenic and aromatic in nature, and each fraction is separately cracked in the presence of zeolitic cracking catalyst in a fluidized catalytic cracking system employing riser reactors. In each reactor, the contact time between the hydrocarbon feedstock and the catalyst is limited to less than one second; the contact time is preferably within the range of from about 0.2 to about 1 second.

Separation of straight chain paraffin hydrocarbons from vapor phase mixtures containing both straight chain and non-straight chain hydrocarbons by adsorption on an aluminosilicate molecular sieve selective adsorbent is known from U.S. Pat. Nos. 3,373,103 and 3,523,075, for example, incorporated herein by reference. Such processes are well known in the art and need not be described in detail herein. Suitable solid adsorbents for straight chain hydrocarbons include H-mordenite, erionite, faujasite, Y, X, and A zeolites, and ZSM-5 type zeolites. Preferred adsorbents are those calcium aluminosilicates marketed under the tradename Linde Molecular Sieve Type 5A or 5A-45 having pore size or opening in the range of about 4 to less than 6 angstrom units. The pore size of the molecular sieve must be sufficiently large to admit straight chain hydrocarbons, such as normal paraffins and normal olefins, in preference to non-straight chain hydrocarbons, particularly naphthenic and aromatic hydrocarbons.

Adsorption is carried out in the vapor phase at an elevated temperature by passing the mixed hydrocarbon vapors over a bed of the zeolite, usually at superatmospheric pressure. It is preferable to carry out the adsorption step at a temperature above the dew point of the vaporized feedstream to minimize surface adsorption of the non-paraffinic hydrocarbons on the selective adsorbent and to minimize the holdup of the charge stock in the interstices of the molecular sieve particles. Usually, the adsorber temperature is kept below that at which cracking of the charge stock occurs. Temperatures in the range of 300° to 360° C. in the adsorption step are satisfactory. The pressure of the adsorption step may vary depending upon the nature of the feedstock and the extent of adsorption of the normal paraffins desired. Conventionally, the adsorber is operated at a pressure in the range of 1.08 bar to 4.5 bar. In accordance with the present invention, the adsorption step is operated at a pressure of about 0.7 bar and at a temperature in the range of 315° to 400° C.

In conventional processes for the separation of normal paraffins from hydrocarbon mixtures, desorption of the hydrocarbons from the molecular sieve is carried out at a pressure lower than the adsorption pressure, i.e. usually in the range of 1 to 1.8 bar and a suitable purge gas is introduced into the adsorption vessel in a direction opposite the direction of flow of the charge stock during the adsorption step. The purge medium may be a vaporized stream of the desorbing medium, described hereinafter. The purge step may be carried out at substantially the same temperature as the adsorption and desorption steps, but usually is at a reduced pressure as compared with the adsorption step. The purge medium is preferably a straight chain hydrocarbon or mixture of straight chain hydrocarbons having an average of 1 to 3 carbon atoms per molecule less than the lowest molecular weight straight chain hydrocarbon in the fresh feed charge to the adsorption vessel. The purge vapor volume may be within the range of 0.2 to 4.0 volumes per volume of molecular sieve. After completion of the purge step, the vessel containing the molecular sieve is repressured to desorption pressure, which may be at a pressure higher than the pressure in the adsorber. In the desorption stage, desorbing medium is introduced into contact with the molecular sieve adsorbent at a rate of about 0.25 to 3 liquid hourly space velocity (LHSV) to remove the adsorbed straight chain hydrocarbons from the sieve. In the desorption step, the flow of desorbing medium through the bed of molecular sieve adsorbent is preferably countercurrent to the direction of flow of the fresh feed charge during adsorption. Desorption is usually terminated when 25 to 80 percent of the adsorbed hydrocarbons have been displaced from the molecular sieve adsorbent. The partially desorbed molecular sieve is then reused for adsorption of additional amounts of paraffin hydrocarbons. Regeneration of the adsorbent to restore its activity after prolonged use in the process may be necessary; methods for the regeneration of molecular sieve adsorbents are known in the art, for example, U.S. Pat. No. 2,908,639.

In a preferred embodiment of the process of this invention the loaded molecular sieve, i.e. molecular sieve having paraffin hydrocarbons adsorbed in its cell structure, is withdrawn from the adsorption zone and subjected to temperatures effective for the catalytic conversion of its hydrocarbon to products of lower molecular weight, i.e. cracking conditions. The effectiveness of small pore aluminosilicate zeolites as cracking catalysts is known from U.S. Pat. Nos. 3,702,886; 3,755,145; and 3,759,821, incorporated herein by reference.

Processes involving conventional solvent dewaxing of petroleum oil base stocks are well known in the art. In general, a suitable solvent is added to a waxy oil base stock and the mixture cooled at a controlled rate to a temperature at which solid wax crystals form in the mixture. As the temperature is progressively lowered, the amount of wax precipatated from the oil-solvent mixture increases until the desired final dewaxing temperature is reached. The wax crystals may then be separated from the oil-solvent mixture by filtration and solvent recovered from the dewaxed oil for reuse in the process. Such prior art processes are illustrated for example in U.S. Pat. Nos. 3,764,517; 4,115,243; and 4,140,620, incorporated herein by reference.

In most of the industrial processes for the separation of wax from petroleum oil stocks, dewaxing solvent is mixed with the oil incrementally, i.e., a portion of the solvent is mixed with the oil before chilling and additional chilled solvent is added to the oil base stock at one or more points during the chilling process. Generally, the waxy oil feedstock is prediluted with solvent at a temperature sufficient to ensure complete miscibility of the oil and solvent prior to chilling. The waxy oil and solvent may be chilled at a rate in the range of 0.5° to 2.5° C. per minute, usually in a scraped surface heat exchanger.

Solvents known to be useful in solvent dewaxing processes include propane; ketones containing 3 to 6 carbon atoms, for example acetone, methylethylketone (MEK) and methyisobutylketone (MIBK); mixtures of ketones; and mixtures of ketones with aromatic hydrocarbons, including benzene and toluene.

In commercial solvent dewaxing processes, separation of crystalline wax from dewaxed oil-solvent solutions is commonly accomplished by means of rotary drum vacuum filters. Wax separated from the dewaxed oil-solvent mixture by filtration is generally referred to as slack wax and the filtration step is referred to as primary filtration. Slack wax from a primary filter contains petrolatum associated with the wax crystals. Slack wax from a primary filter is suitable as the paraffin-rich charge stock for fluid catalytic cracking in the process of this invention.

The single FIGURE of the drawing illustrates schematically an arrangement of process steps suitable for carrying out the process of this invention.

With reference to the drawing, a virgin vacuum gas oil is introduced through line 1 to heater 2 where it is heated to a temperature in the range of 315° to 400° C., preferably at a pressure in the range of 0.5 to 0.9 bar effecting vaporization of a portion of the feedstock. The vaporized portion passes through line 3 to a paraffins separation zone 4 where paraffinic hydrocarbons are separated from non-paraffin hydrocarbons contained in the vaporized portion of the feedstock. In a preferred embodiment, separation zone 4 comprises crystalline aluminosilicate molecular sieve selective adsorbent capable of selectivity adsorbing paraffins. The adsorption step suitably is carried out with a synthetic zeolite molecular sieve having pore size openings of 4 to less than 6 angstroms at a subatmospheric pressure, e.g. about 0.7 bar and a temperature in the range of 315° to 400° C. Paraffinic hydrocarbons are selectively adsorbed from the hydrocarbon vapors in zone 4 by the molecular sieve adsorbent. Unabsorbed hydrocarbons are discharged from zone 4 through line 6 to hydrotreater 7. Unvaporized vacuum gas oil bypasses zone 4 and flows through line 8 to hydrotreater 7 where it is mixed with deparaffined vacuum gas oil from zone 4 supplied to the hydrotreater via line 6 and the mixture subjected to mild hydrogenation. Hydrogen is supplied to the hydrotreater through line 9 from a source described hereinafter.

Hydrotreater 7 is operated in known manner under relatively mild hydrogenation conditions to partially saturate multi-ring aromatic components of the deparaffined oil and unvaporized portion of the charge stock. The catalytic hydrogenation may be carried out in the presence of a hydrogenation catalyst at a temperature within the range of about 330° to 350° C. at a pressure in the range of about 35 to about 70 bar with hydrogen rates of about 90 to about 350 standard cubic meters per cubic meter of hydrocarbon feedstock. Suitable hydrotreating catalysts include those comprising a Group VI metal or compound of a Group VI metal, and an iron group metal or a compound of an iron group metal, supported on a refractory inorganic oxide of silica, alumina, magnesia, zirconia, and mixtures thereof.

The hydrotreated fraction of the feedstock, comprising hydrotreated deparaffined vacuum gas oil and the hydrotreated portion of the feedstock boiling above about 315° C., are passed through line 11 to a fluid catalytic cracking unit 12 of the riser type wherein it is subjected to conversion in the presence of a zeolite catalyst at a pressure in the range of 1.4 to 2 bar with riser outlet temperature in the range of 520° to 540° C. with contact time and catalyst-to-oil ratio effective for approximately 75 percent conversion of the feed to products of lower molecular weight than the feedstock. Liquid products of the fluid catalytic cracking unit 12 are discharged through line 13 while the normally gaseous products are delivered through line 14 to a gas recovery system 15.

A paraffin fraction adsorbed by the molecular sieve in paraffins separation zone 4 is taken from the adsorber with the molecular sieve adsorbent and transferred via line 17 to a vacuum fluid catalytic cracking unit 18 of the riser type where it is subjected to cracking at a riser outlet temperature in the range of 650° to 700° C. at a subatmospheric pressure, preferably of the order of 0.3 to 0.6 bar. The regenerated molecular sieve is returned to separator 4 by line 19. Liquid products from vacuum fluid catalytic cracking unit 18 are delivered through line 20 for use as gasoline blending stocks. The normally gaseous products pass through line 21 to gas recovery system 15 where they are separated into various fractions. A hydrogen rich gas stream containing about 90 volume percent hydrogen is taken from the gas recovery system 15 through line 9 to hydrotreater 7 as the source of hydrogen for the hydrotreater. Other normally gaseous products including light olefins, particularly high yields of two and three carbon atom olefins, are sent through line 22 to other separation facilities for use as petrochemicals feedstocks.

In another embodiment of the process, the sequence of process steps is the same as that described above and illustrated in the FIGURE except that paraffins adsorbed on the molecular sieve in separation zone 4 are desorbed from the sieve and the desorbed paraffins, free from the molecular sieve adsorbent, are passed through line 17 to the vacuum fluid catalytic cracking unit 18 where it is subjected to catalytic cracking in a riser reactor with a conventional zeolite cracking catalyst. In a still further embodiment of the process of this invention, the paraffins separation zone 4 comprises a conventional solvent dewaxing method. Slack wax from primary filtration of solidified wax from a dewaxed solvent-oil mixture is passed through line 17 to the fluid catalytic cracking unit 18 where it is contacted with a conventional zeolite cracking catalyst is a riser reactor under cracking conditions. In these modifications, a paraffins-rich fraction containing essentially none of the molecular sieve absorbent or the dewaxing solvent is delivered to the fluid catalytic cracking unit 18 via line 17.

Advantages of the process of this invention as compared with conventional fluid catalytic cracking of paraffinic vacuum gas oil fractions are apparent from the following specific examples.

EXAMPLES

The following examples are illustrative of the improvements in product yields and product quality, based on octane numbers of the debutanized naphtha product, obtainable from the process of this invention under typical commercial FCCU reaction conditions.

For the purpose of these examples, a virgin gas oil from a paraffin base (Berri) crude oil is taken as an illustrative paraffin base gas oil charge stock to a FCCU. Physical properties of the untreated virgin gas oil are shown in Table I.

TABLE I

| Charge Stock | |
|---|---|
| Gravity, °API | 27.7 |
| UOP K Factor | 11.91 |
| Conradson Carbon Residue | 0.19 |
| Sulfur, wt. % | 1.52 |
| Basic Nitrogen, wppm | 239 |
| ASTM Distillation (D1160) | |
| 50% point, °C. | 397 |
| Carbon Type Analysis | |
| Aromatic, wt. % | 17.9 |
| Naphthenes, wt. % | 15.9 |
| Paraffins, wt. % | 66.9 |
| Mass Spectrometer Analysis | |
| Aromatics, wt. % | 43.7 |
| Paraffins, wt. % | 26.2 |
| Naphthenes, wt. % | 28.3 |
| Molecular Weight | 351 |

EXAMPLES 1–4

The following examples 1 through 4 show the estimated yield and physical properties of deparaffined gas oil obtainable by removing various amounts of paraffinic compounds from the virgin gas oil of Table I. The weight percent paraffin removal is calculated on the basis of the total paraffins measured by the mass spectrograph. The data in Table II are estimated assuming that only paraffins are removed from the virgin gas oil, that the boiling ranges of both the paraffinic components and the de-paraffined gas oil are the same as the boiling range of the virgin gas oil and that the specific gravity of the paraffins removed is 0.7835 at 60° F. (15.6° C.).

TABLE II

Feedstock Composition vs Paraffin Removal

| | Examples | | | |
|---|---|---|---|---|
| | 1 | 2 | 3 | 4 |
| Paraffin Removal, wt % | 25 | 50 | 75 | 95 |
| Gravity, °API | 26.2 | 24.4 | 22.5 | 20.6 |
| UOP K Factor | 11.56 | 11.16 | 10.78 | 10.45 |
| Conradson Carbon Residue | 0.20 | 0.22 | 0.24 | 0.25 |
| Sulfur, wt. % | 1.63 | 1.75 | 1.90 | 2.03 |
| Basic Nitrogen, wppm | 257 | 276 | 299 | 321 |
| ASTM Distillation 50% point, °C. | 397 | | | |
| Carbon Type Analysis | | | | |
| Aromatic, wt. % | 21.3 | 23.4 | 25.8 | 28.1 |
| Naphthenes, wt % | 13.0 | 14.4 | 15.2 | 16.5 |
| Paraffins, wt. % | 65.7 | 62.2 | 58.9 | 55.4 |
| Mass Spectrometer | | | | |

TABLE II-continued

Feedstock Composition vs Paraffin Removal

| | Examples | | | |
|---|---|---|---|---|
| | 1 | 2 | 3 | 4 |
| Analysis | | | | |
| Aromatics | 47.0 | 50.5 | 54.6 | 58.5 |
| Paraffins, wt % | 21.1 | 15.1 | 8.2 | 1.3 |
| Naphthenes | 30.4 | 32.7 | 35.3 | 37.9 |
| Molecular Weight | 347 | 341 | 336 | 330 |
| YIELD BASIS FF, WT % | 93.4 | 86.9 | 80.3 | 75.1 |
| YIELD BASIS FF, VOL % | 93.3 | 85.1 | 77.7 | 71.8 |

EXAMPLES 5–8

Examples 5 through 8, show the estimated yield and physical properties of deparaffined hydrotreated gas oil obtainable on hydrotreating the deparaffined gas oils of Examples 1 through 4 under the conditions indicated in the table. The carbon type analyses are estimated assuming a constant percentage of paraffins with all aromatic saturation forming naphthenes.

TABLE III

Feedstock Composition Resulting from Paraffin Removal and Hydrotreating

| | Example No. | | | |
|---|---|---|---|---|
| | 5 | 6 | 7 | 8 |
| Paraffin Removal, wt % | 25 | 50 | 75 | 95 |
| Gravity, °API | 33.9 | 32.0 | 30.0 | 28.0 |
| UOP K Factor | 12.40 | 12.26 | 12.11 | 11.96 |
| Conradson Carbon Residue | 0.02 | 0.02 | 0.02 | 0.02 |
| Basic Nitrogen, wppm | 45.2 | 48.6 | 52.6 | 56.5 |
| ASTM Distillation 50% point, °C. | | 390 | | |
| Carbon Type Analysis | | | | |
| Aromatic, wt. % | 13.3 | 14.7 | 16.5 | 18.1 |
| Naphthenes, wt % | 21.0 | 23.1 | 24.6 | 26.5 |
| Paraffins, wt % | 65.7 | 62.2 | 58.9 | 55.4 |
| Mass Spectrometer Analysis | | | | |
| Aromatics, wt. % | 33.5 | 35.9 | 38.9 | 41.7 |
| Paraffins, wt. % | 21.1 | 15.1 | 8.2 | 1.3 |
| Naphthenes, wt. % | 45.4 | 48.9 | 52.7 | 56.6 |
| Molecular Weight | 362 | 356 | 349 | 343 |
| $H_2$ Consumption, $m^3/l$ | | 0.13145 | | |
| Hydrotreater Conditions | | | | |
| Catalyst Bed Temp. °C. | | 390 | | |
| LHSV[1] | | 1.0 | | |
| $H_2$ Partial Pres. bar | | 73.4 | | |
| Yield, Vol % | 97.0 | 89.2 | 81.5 | 75.2 |

[1]Liquid hourly space velocity

EXAMPLES 9–13

In the following examples, Examples 9 through 13, the virgin gas oil of Table I and the deparaffined hydrotreated gas oils of Table III are employed as feed to a riser reactor type FCCU. All of the examples are based on correlations of runs made on a 5 barrel per day fluid catalytic reactor which closely simulates commercial size FCCU results. The catalyst for these examples is assumed to be an equilibrium catalyst from a commercial FCCU comprising a Y zeolite in a silica-alumina matrix, i.e., Davison CBZ-1 available from Davison Chemical Division of W. R. Grace & Company. Data for all runs are based on a riser reactor outlet temperature of 520° C. (970° F.), gas oil conversion of 74 volume percent and a catalyst addition of 0.1 pound per barrel of charge stock. Estimated yields and product octanes are shown in Table IV.

TABLE IV

Estimated Overall Yields and Octanes +520° C. Riser Temperature

| | Example No. | | | | |
|---|---|---|---|---|---|
| | 9 | 10 | 11 | 12 | 13 |
| Paraffin Removal, wt % | 0 | 25 | 50 | 75 | 95 |
| Yields, wt % | | | | | |
| Hydrogen Sulfide | 0.72 | 0.08 | 0.08 | 0.07 | 0.07 |
| Hydrogen | 0.06 | 0.13 | 0.19 | 0.23 | 0.28 |
| Methane | 0.99 | 2.36 | 3.29 | 4.17 | 4.91 |
| Ethane | 0.73 | 1.56 | 2.01 | 2.51 | 2.90 |
| Ethylene | 0.69 | 2.16 | 3.28 | 4.44 | 5.34 |
| Propane | 1.19 | 1.47 | 1.47 | 1.52 | 1.54 |
| Propylenes | 4.17 | 5.76 | 6.98 | 7.38 | 8.05 |
| Isobutane | 2.86 | 3.59 | 3.34 | 3.19 | 3.07 |
| N Butane | 1.10 | 1.25 | 1.17 | 1.11 | 1.07 |
| Butylenes | 5.06 | 5.81 | 5.98 | 6.32 | 6.58 |
| DB Naphtha | 50.00 | 60.63 | 56.18 | 50.69 | 46.48 |
| Light Gas Oil | 17.99 | 5.82 | 7.05 | 8.35 | 9.24 |
| Heavy Gas Oil | 9.81 | 3.51 | 3.89 | 4.44 | 4.93 |
| Coke | 4.63 | 5.82 | 5.64 | 5.58 | 5.54 |
| DB Naphtha Product Quality | | | | | |
| Research Octane | 90.8 | 90.9 | 92.0 | 92.3 | 92.9 |
| Motor Octane | 79.7 | 79.7 | 79.7 | 80.0 | 80.5 |
| API Gravity | 59.8 | 57.9 | 57.8 | 58.0 | 58.3 |
| RON Octane Barrels | 54.6 | 63.2 | 61.5 | 54.9 | 51.5 |
| MON Octane Barrels | 47.9 | 60.6 | 53.4 | 47.6 | 44.6 |

EXAMPLES 14–18

Table V, below, shows estimated product yield and quality data for the same charge stocks as those in Table IV except that Examples 14 through 18 are for a riser reactor outlet temperature of 540° C. (1000° F.) rather than the temperature of 520° C. (970° F.) of Examples 9 through 13.

TABLE V

Estimated Overall Yields and Octanes 540° C. Riser Temperature

| | Example | | | | |
|---|---|---|---|---|---|
| | 14 | 15 | 16 | 17 | 18 |
| Paraffin Removal, wt % | 0 | 25 | 50 | 75 | 95 |
| Yields, wt % | | | | | |
| Hydrogen Sulfide | 0.72 | 0.08 | 0.08 | 0.07 | 0.07 |
| Hydrogen | 0.07 | 0.16 | 0.20 | 0.26 | 0.29 |
| Methane | 1.21 | 2.77 | 3.60 | 4.46 | 5.15 |
| Ethane | 0.90 | 1.86 | 2.28 | 2.73 | 3.09 |
| Ethylene | 0.86 | 2.46 | 3.53 | 4.64 | 5.52 |
| Propane | 1.32 | 1.56 | 1.56 | 1.60 | 1.63 |
| Propylenes | 4.64 | 6.09 | 6.81 | 7.69 | 8.36 |
| Isobutane | 3.18 | 3.84 | 3.58 | 3.43 | 3.29 |
| N Butane | 1.23 | 1.34 | 1.25 | 1.20 | 1.19 |
| Butylenes | 5.63 | 6.18 | 6.35 | 6.69 | 6.94 |
| DB Naphtha | 47.81 | 58.49 | 59.18 | 48.86 | 44.30 |
| Light Cycle Gas Oil | 17.99 | 5.82 | 7.05 | 8.35 | 9.24 |
| Heavy Cycle Gas Oil | 9.81 | 3.51 | 3.89 | 4.44 | 4.94 |
| Coke | 4.63 | 5.82 | 5.64 | 5.58 | 5.54 |
| DB Naphtha Product Quality | | | | | |
| Research Octane | 92.3 | 92.3 | 93.4 | 93.8 | 94.1 |
| Motor Octane | 80.2 | 80.2 | 80.8 | 81.4 | 81.7 |
| API Gravity | 59.8 | 57.6 | 57.8 | 58.0 | 58.2 |
| RON Octane Barrels | 53.0 | 61.7 | 58.6 | 53.3 | 50.1 |
| MON Octane Barrels | 46.1 | 53.6 | 50.7 | 46.7 | 43.5 |

EXAMPLE 19

The following example illustrates predicted product yields and quality obtainable by subjecting paraffins separated from a paraffinic catalytic cracking charge stock, such as the virgin gas oil of Table I to catalytic cracking in a pure riser reactor at a riser outlet temperature of 680° C. (1255° F.).

TABLE VI

| Estimated Yields - High Temperature FCCU Straight Paraffin Feedstock | |
|---|---|
| Reactor Temperature, C. | 680 |
| Reactor Pressure, Bar | 0.48 |
| Yields, wt % | |
| Hydrogen | 0.9 |
| Methane | 16.1 |
| Ethane | 18.9 |
| Ethylene | 9.0 |
| Propane | 1.7 |
| Propylenes | 16.7 |
| Isobutane | 1.0 |
| N Butane | 0.1 |
| Butylenes | 8.1 |
| Coke | 6.4 |
| Total DB Naphtha | 19.0 |
| Research Octane | 85 |
| Motor Octane | 75 |
| API Gravity | 54 |
| Total Gas Oil | 2.1 |

EXAMPLES 20–23

Table VII indicates the predicted overall yields, on an annual basis, from conventional FCCU operation on the virgin gas oil feedstock of Table I at 520° C. (Example 20) and 540° C. (Example 22) basis 50 thousand barrels per day (MBCD) or 7.95 million liters per day (MLCD) of charge to a FCC riser type reactor according to Examples 9 and 14. Example 21 provides data at 520° C. based on the process of this invention in which the same volume of feedstock charge (50 MBCD) is processed according to Examples 3, 7 and 12. Similarly, Example 23 provides comparison data at 540° C. riser reactor temperature processed according to Examples 3, 7 and 17.

TABLE VII

| Product Rates (Annual Basis) | Examples | | | |
|---|---|---|---|---|
| | 20 | 21 | 22 | 23 |
| Paraffin Removal, wt % | 0 | 75 | 0 | 75 |
| Riser Temperature, | | | | |
| °C. | 520 | 520 | 540 | 540 |
| °F. | 970 | 970 | 1000 | 1000 |
| Hydrogen $10^6$ kg/yr | 0 | 19.1 | 0 | 18.3 |
| Methane, $10^9$ kg/yr | 0.0255 | 0.1075 | 0.3116 | 0.1148 |
| Ethylene, $10^9$ kg/yr | 0.0178 | 0.114 | 0.022 | 0.120 |
| Propylene, $10^9$ kg/yr | 0.107 | 0.190 | 0.119 | 0.198 |
| Total Butanes, $10^9$ kg/yr | 0.233 | 2.735 | 0.259 | 2.917 |
| DB Naphtha, $10^6$ LPCD | 4.77 | 4.72 | 4.56 | 4.56 |
| Octane, RON | 90.8 | 92.3 | 92.3 | 93.8 |
| Octane, Barrels, RON | 54.6 | 54.9 | 53.0 | 53.8 |
| Cycle Oils, $10^9$ kg/yr | 0.708 | 0.330 | 0.717 | 0.330 |

We claim:

1. In a process for conversion of heavy paraffinic vacuum gas oil fractions into desirable products by a fluid catalytic cracking process, the improvement which comprises separating paraffins from the vacuum gas oil thereby producing a deparaffined oil, hydrotreating said deparaffined oil, subjecting hydrotreated deparaffined oil to catalytic cracking in a first fluid catalytic cracking zone at a temperature in the range of 520° to 540° C., separately subjecting said paraffins removed from the vacuum gas oil to catalytic cracking in a second fluidized catalytic cracking zone at a temperature in the range of 650° to 700° C., and recovering light olefins and normally liquid motor fuel blending components from the products of said fluid catalytic cracking operations.

2. A process according to claim 1 wherein the pressure in said second catalytic cracking zone is within the range of 0.3 to 0.6 bar.

3. A process according to claim 1 wherein said vacuum gas oil is subjected to solvent dewaxing for the removal of paraffins.

4. A process according to claim 1 wherein said paraffins are removed from said vacuum gas oil by selective adsorption with a molecular sieve.

5. A process according to claim 4 wherein said molecular sieve comprises a crystalline aluminosilicate zeolite having uniform pore openings in the range of about 4 to less than 6 angstrom units.

6. A process according to claim 5 wherein said zeolite is a molecular sieve selective adsorbent of Type 5A structure.

7. A process according to claim 6 wherein said molecular sieve is introduced into an adsorption zone into contact with a vaporized portion of said vaccum gas oil feedstock effecting adsorption of straight chain hydrocarbon components by the molecular sieve selective adsorbent and thereafter introduced into a fluidized catalytic cracking reaction zone wherein adsorbed normal paraffin is subjected to cracking in the presence of said Type 5A molecular sieve as catalyst for catalytic cracking of adsorbed normal paraffins.

8. A process for the conversion of paraffin base petroleum catalytic cracking feedstocks to high octane motor fuels and petrochemical feedstocks which comprises:

(a) removing at least a part of the paraffinic components from said paraffinic base stock to yield a deparaffined fraction and a paraffins-containing fraction, (b) subjecting said deparaffined fraction to hydrogenation under mild hydrogenation reaction conditions in a hydrotreating zone, (c) subjecting said hydrotreated deparaffined fraction to fluid catalytic cracking in the presence of a zeolitic catalytic cracking catalyst in a first riser type reaction zone having an outlet temperature in the range of 520° to 540° C., (d) subjecting said paraffins-containing fraction to fluid catalytic cracking in a second riser type reaction zone at an outlet temperature in the range of 650° to 700° C. with the production of highly aromatic normally liquid hydrocarbons including high octane motor fuel components together with gaseous olefins and hydrogen, and (e) recovering gaseous olefins and normally liquid products including high octane motor fuel components from the effluents of said fluid catalytic cracking reaction zones.

9. A process as defined in claim 8 wherein the pressure in said second riser reactor is within the range of 0.3 to 0.6 bar.

10. A process as defined in claim 8 wherein a hydrogenrich stream containing at least 90 volume percent hydrogen is recovered from the products of said second fluid catalytic cracking reaction zone and introduced into said hydrotreating zone as a source of hydrogen therefor.

11. A process according to claim 8 wherein said catalytic cracking stock is heated to a temperature in the range of 315° to 400° C. and subjected to flash vaporization to produce a vapor fraction and a liquid fraction, said vapor fraction is subjected to treatment for the removal of paraffinic components therefrom and the resulting deparaffined portion is combined with said unvaporized fraction as feed to said hydrotreater.

12. A process according to claim 11 wherein said vapor fraction is contacted in vapor phase with a zeolite absorbent having a pore size within the range of 4 to less than 6 angstroms effecting sorption of paraffins to the substantial exclusion of non-paraffins and subjecting said sorbed paraffins to catalytic cracking in said second reaction zone in the presence of said zeolite absorbent as said cracking catalyst.

13. A process according to claim 11 wherein said vapor fraction is contacted in vapor phase with a Type 5A zeolite having pore openings in the range of 4 to 5 angstroms effecting removal of paraffins from said vapor fraction and producing a deparaffined fraction, said deparaffined fraction is mixed with said liquid fraction and the mixture subjected to mild hydrogenation, paraffins are recovered from said zeolite, and said recovered paraffins are subjected to catalytic cracking in said second catalytic cracking reaction zone.

14. A process according to claim 11 wherein said vapor fraction is condensed and subjected to solvent dewaxing effecting removal of solidified paraffin wax from a dewaxed oil fraction, and said paraffin wax is subjected to catalytic cracking in said second catalytic cracking reaction zone at a pressure in the range of 0.3 to 0.6 bar.

* * * * *